US006701660B2

(12) United States Patent
Stover

(10) Patent No.: US 6,701,660 B2
(45) Date of Patent: Mar. 9, 2004

(54) UNIVERSAL SCOPE MOUNT FOR MUZZLE RIFLE

(75) Inventor: Gerald E. Stover, Lapeer, MI (US)

(73) Assignee: William Gun Sight Co., Davison, MI (US)

( * ) Notice: Subject to any disclaimer, the term of this patent is extended or adjusted under 35 U.S.C. 154(b) by 0 days.

(21) Appl. No.: 10/079,676

(22) Filed: Feb. 20, 2002

(65) Prior Publication Data

US 2003/0154641 A1 Aug. 21, 2003

(51) Int. Cl.[7] ..... F41C 3/14
(52) U.S. Cl. ..... 42/124; 42/126; 42/127
(58) Field of Search ..... 42/124, 126, 127

(56) References Cited

U.S. PATENT DOCUMENTS

| | | | | | |
|---|---|---|---|---|---|
| 2,743,526 | A | * | 5/1956 | Ivy | 42/126 |
| 3,260,001 | A | * | 7/1966 | Weaver | 42/124 |
| 3,835,565 | A | * | 9/1974 | Weast | 42/90 |
| 3,877,166 | A | * | 4/1975 | Ward | 42/127 |
| 4,164,076 | A | | 8/1979 | Carrigan | |
| 4,249,315 | A | | 2/1981 | Hopson, III | |
| 4,446,644 | A | * | 5/1984 | Jimenez et al. | 42/127 |
| 4,509,282 | A | | 4/1985 | McMillon | |
| 4,688,345 | A | * | 8/1987 | Kilgour | 42/127 |
| 4,776,126 | A | | 10/1988 | Williams | |
| 4,862,624 | A | | 9/1989 | Williams | |
| 4,873,779 | A | | 10/1989 | Ellison et al. | |
| 5,208,407 | A | | 5/1993 | Stover | |
| D343,440 | S | | 1/1994 | Rubin et al. | |
| 5,428,915 | A | * | 7/1995 | King | 42/126 |
| 5,481,818 | A | | 1/1996 | Stover | |
| 5,684,467 | A | | 11/1997 | Hur | |
| 5,694,712 | A | | 12/1997 | Plonka | |
| 5,805,071 | A | | 9/1998 | Hur | |

* cited by examiner

*Primary Examiner*—Michael J. Carone
*Assistant Examiner*—M. Thomson
(74) *Attorney, Agent, or Firm*—Harness, Dickey & Pierce, PLC

(57) ABSTRACT

A universal scope mount for attaching a scope to a variety of rifles, without requiring the rifle to be modified by drilling, or the need to purchase multiple scope mounts. Comprised of identical front and rear mounting assemblies having a mounting plate and a corresponding scope attachment ring. The bases comprise a planar mounting surface embodying a radial recess down the center, along with at least 3 pairs of mounting holes for attachment to rifles having different screw patterns and mounting surfaces. The mounting rings are received and attached within longitudinal channels along the mounting bases, and the scope subsequently clamped in place by the upper and lower attachment rings.

5 Claims, 3 Drawing Sheets

UNIVERSAL SCOPE MOUNT FOR MUZZLE RIFLE

FIELD OF THE INVENTION

The present invention relates to a scope mount used on black powder rifles. More specifically this invention relates to a scope mount that can be universally mounted on a variety of different rifles from different manufacturers, without modifying the firearms.

BACKGROUND OF THE INVENTION

Since the first field scopes that were attached to a hunter's rifle, used to enhance a hunters ability to fire a more direct shot at their desired target, there have been many different methods of securing the instrument to the firearm. Not only must a mount for a scope provide a secure attachment to the gun, it must be able to maintain the scope's alignment after successive shots have been fired. A significant problem that arises in which the present invention overcomes is that gun manufacturers use a variety of different mounting patterns for scopes on the top of their guns and rifles. In order to achieve the secure attachment necessary for a scope, individualized mounts have been required for the various manufacturers of guns or rifles on the market.

This becomes a large inconvenience for hunters that prefer to use a single scope on several different rifles. In order for them to change rifles to accommodate a single scope, they would have to remove the scope from the mount of one rifle, and attach it to a separate mount for the second rifle. Accordingly, if the hunter were to remove the scope from the mount, and attach it to the mount of the second rifle, he would have to realign the reticles of the scope with respect to the mount, as well as adjust the eye relief distance of the scope and zero it before use. Eye relief relates to the distance between the shooters eye and the end of the scope through which the shooter seeks his target. This process takes skill and time, notwithstanding the need for the hunter to purchase a separate scope mount for each individual gun. This problem is overcome in the present invention by allowing the user to mount a single scope to a large variety of rifles without requiring the scope to be switched from one mount to another.

There have been earlier universal-type scope mounts disclosed, but the differences and advantages of the present invention will become clear in the description provided hereinafter. U.S. Pat. No. 4,873,779 by inventors Ellison et al. teaches a scope mount base for a black powder rifle that uses multiple holes for attachment to different rifles. The invention discloses a single rear mounting hole and dual forward mounting holes to adapt to two separate mounting patterns on two separate rifles. The advantage of the present invention over Ellison is clear in that not only does the present invention use multiple holes of varying diameter for mounting the scope to a greater variety of rifles, but also embodies a mounting base with both planar and radial surfaces, allowing even greater versatility as far as the number of rifles upon which the scope may be mounted. As a result of the aforesaid shortcomings of prior art scope mounts, the need arose for a single sight mount that can securely attach a scope to a variety of different rifles without having to modify the mount or the rifle prior to attachment.

SUMMARY OF THE INVENTION

It is an object of the present invention to provide a scope mount for a firearm that may be used with a variety of black powder rifle models.

A more specific object of the present invention is to provide universal scope mount which is attachable to a rifle with tapped holes that are factory-formed without having to drill additional holes in the mounting surface of the rifle.

Another object of the present invention is to provide a universal scope mount for rifles that utilizes a plate embodying multiple sets of mounting holes, of specific diameters to adapt to a variety of different hole patterns that are factory-formed within the different rifles.

A further object of the present invention is to provide a universal scope mount utilizing a plate that can attach a scope to a rifle embodying either a flat mounting surface or a round-mounting surface upon the rifle.

It is another object of the present invention to provide a universal scope mount that allows the utilization of a scope and mount from one rifle to be directly mounted on a second rifle having a different mounting pattern.

It is therefore an object of the present invention to provide a universal scope mount which allows a user to transfer a single scope between multiple rifles with little effort or time.

Another object of the present invention is to provide for a universal scope mount which is uncomplicated in construction and easy to manufacture.

The foregoing objects are accomplished in the preferred embodiment of the invention by a rifle scope mount that can universally mount a scope to a plurality of different rifle models, comprising a front and rear mounting plate, and corresponding front and rear scope attachment rings. The identical front and rear mounting plates are rectangular in shape, and comprise a generally I-beam cross-section. Each mounting plate comprises at least three pairs of congruent mounting holes of at least two different diameters, allowing the attachment of the mounting plate to a variety of rifles by using a specific pair of holes in the mounting plate that correlate to the specific hole patterns that are factory-formed within the different rifles. Each mounting plate also comprises a plurality of horizontal holes interspaced between the mounting holes, for selectively fastening the attachment rings holding the scope to the plate.

The front and rear attachment rings which are also identical, each comprise an upper and lower portion. The lower portion embodies a generally C-shaped, downward facing ring comprising two mounting arms for attachment to the mounting plate and an upward facing semi-circular portion upon which the cylindrical body of a scope rests. The upward extending arms of the semi-circular element terminate in generally outward projecting flanges with one or more pre-tapped mounting holes there through for fastening to congruent flanges of the upper portion of the attachment rings, securing the scope body to the attachment rings.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
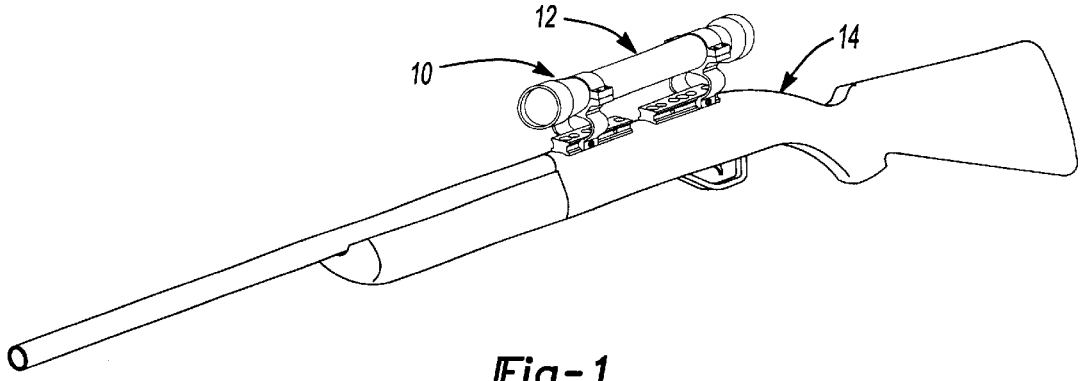
FIG. 1 is a perspective view of the universal gun scope mount of the present invention as attached to a scope sight and mounted to a rifle.
Figure 2:
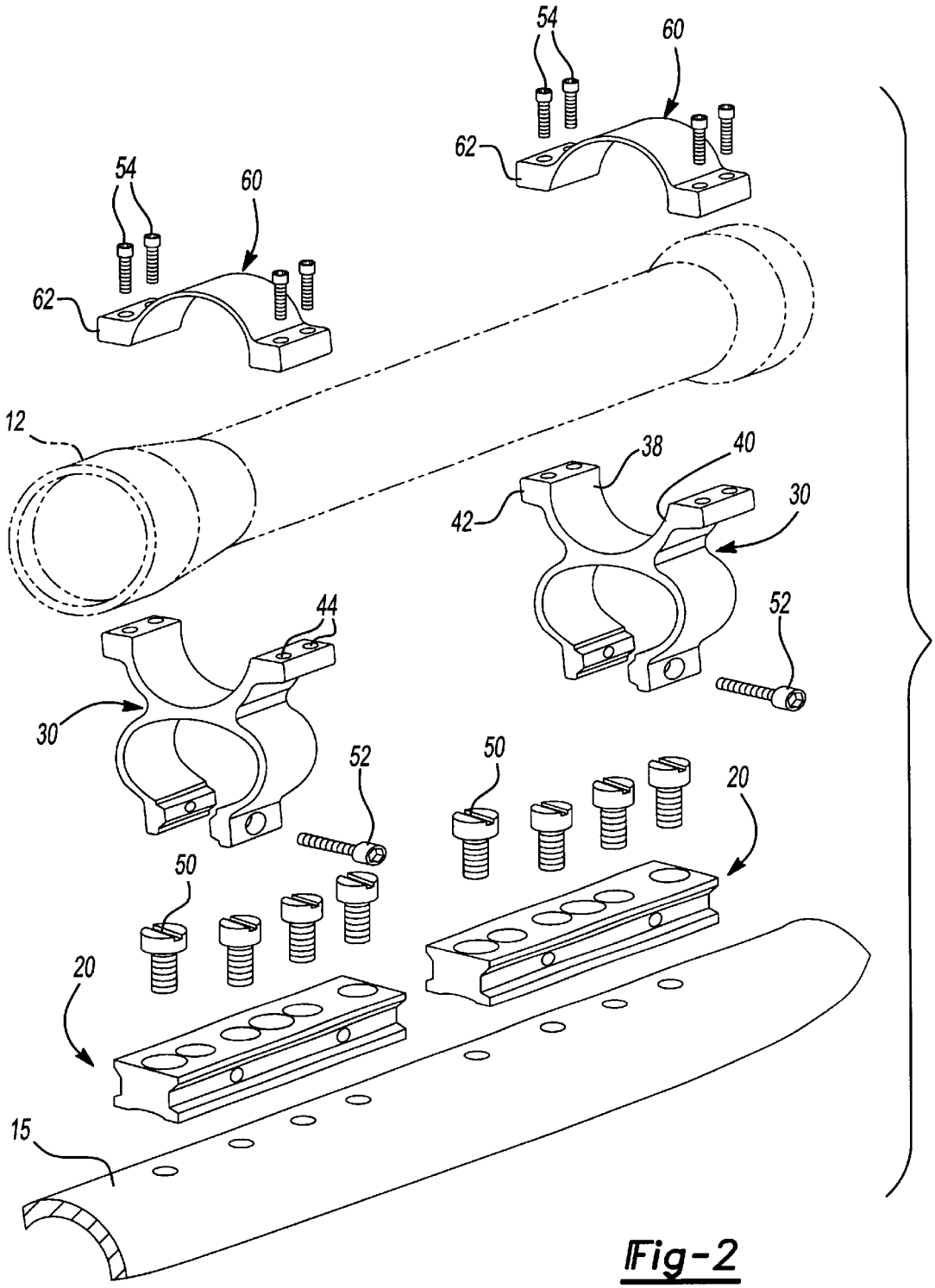
FIG. 2 is an exploded perspective view of the universal gun scope mount of the present invention showing the various components used to attach a sight to a rifle.

Referring to the drawings, and particularly FIG. 1, there is shown therein the universal scope mount of the present invention 10, as attached to a scope 12, and mounted to a rifle 14. FIG. 2, further shows an exploded view of the universal scope mount 10 of the present invention. The universal mount 10 is generally comprised of two identical mounting assemblies, one set to secure the front of a scope 12 to a rifle 14, and one to secure the rear. Both the front and the rear mounting assemblies are comprised of three main elements; a mounting plate 20, a lower mounting ring 30, and an upper mounting ring 60. FIG. 2 further shows of the mounting hardware 50 used to attach the mounting plate 20 to a to the barrel of a rifle 14 having a radial mounting surface 15. Also shown is the hardware 52 used for attaching the lower mounting ring 30 to the mounting plate 20, and the hardware 54 for attaching the upper mounting ring 40 to the lower mounting ring 30, thereby securing a scope 12 in between the lower mounting ring 30 and the upper mounting ring 40 of both the front and rear sets of the present invention.

Figure 3:
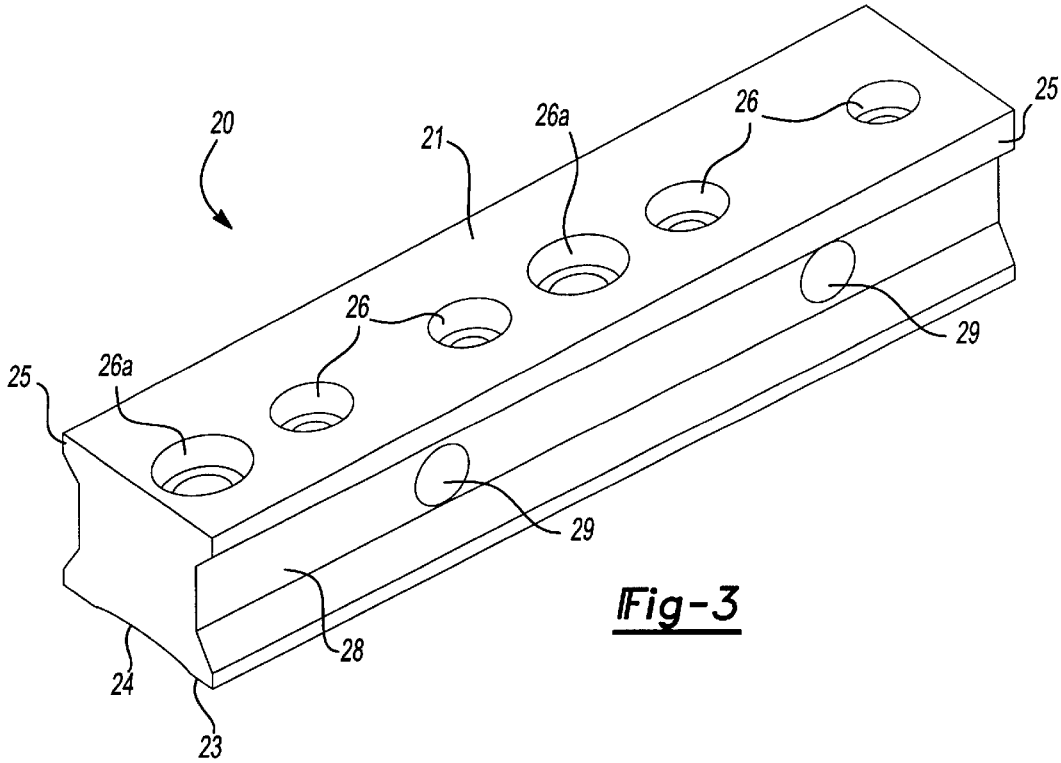
FIG. 3 is a larger, perspective view of one of the mounting bases of the present invention enabling the universal scope mount to be attached to a variety of rifles.

Referring now to FIGS. 2 and 3, the mounting plate 20 of both the front and rear mounting assemblies are comprised of a generally rectangular shape, having a first top surface 21, a bottom surface 23, and two side surfaces 25. The bottom surface 23 of both the front and rear mounting plates 20 further embodies a shallow radius 24 running the length of the bottom surface 23. This radius 24 enables the mounting plate 20 to be securely mounted to rifles 14 having a planar mounting surface or a radial surface as shown in FIG. 2, increasing the mounts versatility to a wider variety of applications. Each of the front and rear mounting plates 20, further embody a channel 28 on both side surfaces 25 running the length of the mounting plate 20. This channel 28 receives the lower mounting ring 30 for attachment thereto.

The front and rear mounting plates 20 further comprise a plurality of holes 26 vertically through the mounting plate 20, with at least one pair of holes 26*a* having a varying diameter than the others. The holes 26 and 26*a* are used in pairs, and more specifically the ones to be used in any given application to receive the mounting hardware 50 depending on the specific rifle 14 to which the mounting plates 20 are to be attached. Embodying multiple holes 26 and 26*a*, allow the mounting plates 20 of the scope mount 10 to be attached to a variety of rifles 14, without the need to drill additional holes in the rifle 14.

Interspaced between the vertical mounting holes 26 and 26*a*, the mounting plate 20 comprises at least one pair of horizontal holes 29 through the mounting plate 20, positioned in the center of the channel 28 a predetermined distance apart from each other. These horizontal attachment holes 29 receive the mounting hardware 52 for attaching the lower mounting ring 30 to the mounting plate 20 of both the front and rear sets of mounting assemblies.

Figure 4:
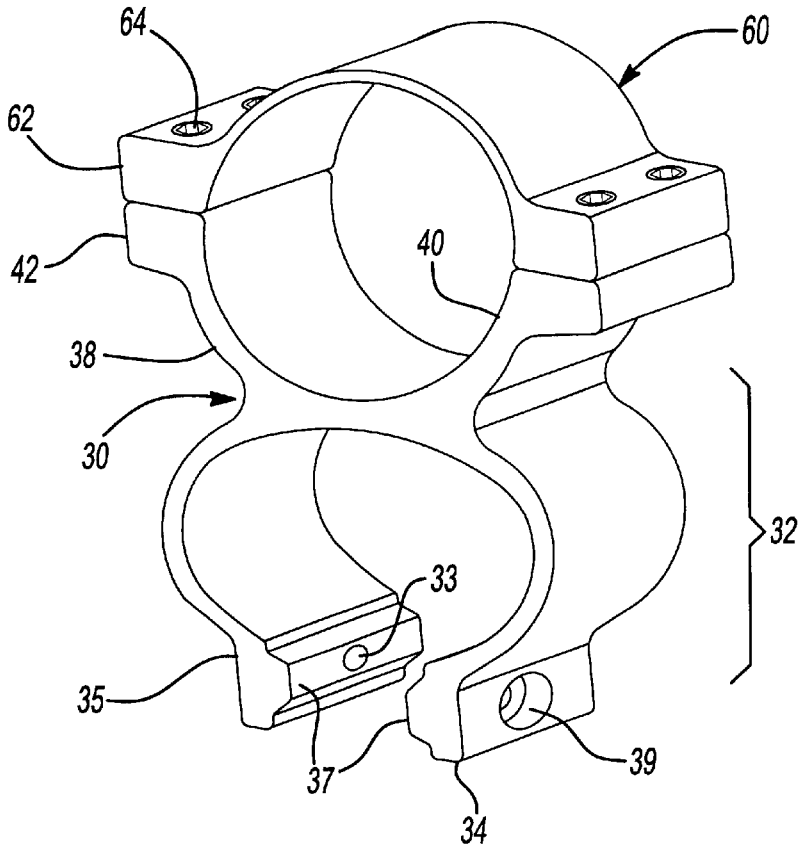
FIG. 4 is a larger, perspective view of one of the scope mounting rings for securing a scope to the universal mounting base of the present invention.
Figure 5:
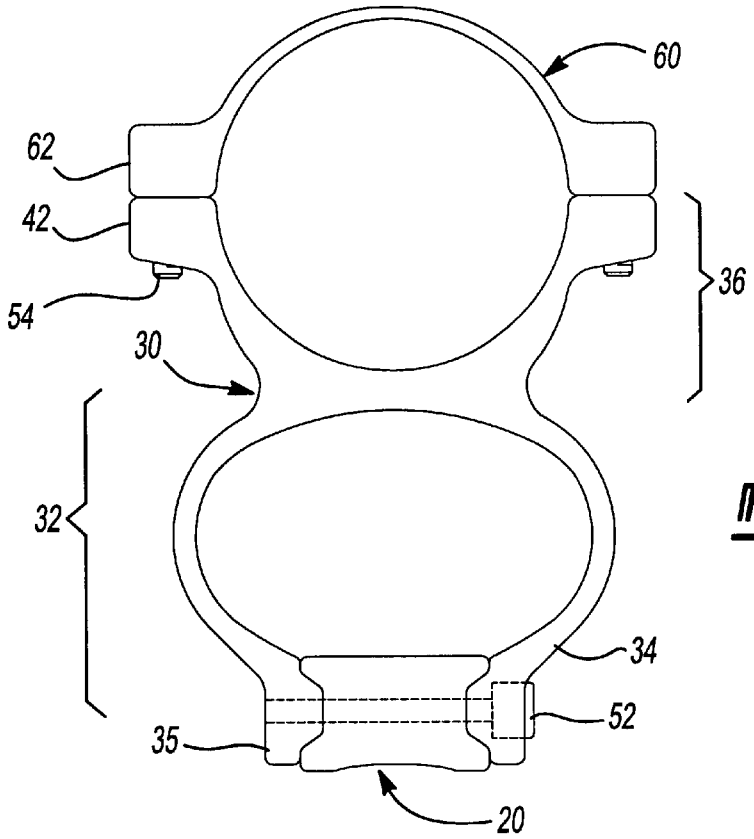
FIG. 5 is an end view of one of the scope mounting rings of the present invention as attached to one of the mounting bases.

Referring now to FIGS. 4 and 5, the lower mounting ring 30 and upper mounting ring 60 are shown attached together. Specifically, FIG. 4 shows both the lower mounting ring 30 and the upper mounting ring 60 unattached to the mounting base 20 as shown in FIG. 5. Each of the single element, lower mounting rings 30 are comprised of a generally C-shaped, downward facing portion 32 with two opposing mounting arms 34 and 35 for attachment to the mounting plate 20, and an upward facing semi-circular portion 36 with two upward extending arms 38 and 40, upon which the cylindrical body of a scope 12 rests. The downward facing mounting arms 34 and 35, each have an inward flange 37, that engage with channels 28 of mounting plate 20, located along the side surfaces 25 of the mounting plate 20 for attachment thereto.

One of the downward facing mounting arms 34, of mounting rings 30, embodies a through-bore 39, through the mounting arm 34 and the inward flange 37. The opposing mounting arm 35 has a complimentary, threaded through-bore in which mounting hardware 52 is received after being inserted through bore 39 and hole 29 of mounting plate 20, for attachment of lower mounting rings 30 to the mounting plate 20.

The upward extending arms 38 and 40 of both front and rear lower mounting rings 30 terminate in generally outward projecting flanges 42 with one or more pre-tapped mounting holes 44 shown in FIG. 2 therethrough for receiving mounting hardware 54, fastening the upper mounting ring 60 to the lower mounting ring 30. The upper mounting ring 60 is generally C-shaped and comprises outward projecting flanges 62 congruent to flanges 42 of the upper portion 36 of the lower mounting rings 30. Both outward projecting flanges 62 have one or more through-bores 64 complimentary to the mounting holes 44 of flanges 42 located on the lower mounting ring 30.

When attaching a scope 12 to a rifle 14, the scope 12 body is positioned between the upward extending arms 38 and 40 of the front and rear lower mounting rings 30. Once scope 12 is in the desired position, the upper mounting rings 60 are placed over the body of the scope 12 directly above the lower mounting rings 30 so that flanges 62 of upper mounting rings 60 align with flanges 42 of lower mounting rings 30. The upper mounting rings 60 and the lower mounting rings 30 are then attached together with mounting hardware 54, thereby clamping the scope 12 in place.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. In combination with a telescopic sight adapted to be removably mounted upon each of a plurality of rifle style firearms, the telescopic sight have a pair of mounting assemblies, each of which comprises an upper ring-shaped sight engagement portion and a pair of downwardly projecting spaced apart mounting arms having inwardly projecting mounting portions thereon;

each of the firearms having a receiver portion provided with an upwardly facing sight mounting surface provided with two pair of longitudinally spaced apart internally tapped upwardly facing bores, the tapped bores of each pair thereof on each of the firearm receivers being spaced a different longitudinal distance apart from the pairs of bores on the other of the firearm receivers, the improvement comprising:

a universal telescopic sight mounting system, comprising a pair of longitudinally spaced apart mounting plates associated one with each of the sight mounting assemblies of the telescopic sight;

each of said mounting plates being provided with a plurality of pairs of longitudinally spaced vertically disposed through-bores, the longitudinal spacing between each pair of through-bores being equal to the longitudinal spacing between the pairs of tapped bores of one of the firearm receivers;

a first fastening means comprising two pairs of threaded fasteners, one of said pairs being associated with one of said adapter plates and the other said pairs being associated with the other of said adapter plates, whereby said adapter plates are adapted to be surmounted on said mounting surface of any of the firearms with one of the pairs of bores in each of the adapter plates being aligned with the corresponding spaced pair of tapped bores in the associated firearm receiver, and be secured to the receiver by one of the pairs of threaded fasteners, each of said adapter plates removably receiving the inwardly projecting mounting portions of one of said sight mounting assemblies, and second fastening means extending laterally through said mounting portions and said adapter plate for fixedly securing said assembles and hence the telescopic sight to the associated of said mounting plates.

2. In combination with a telescopic sight adapted to be removably mounted upon each of a plurality of rifle style firearms, the telescopic sight have a pair of mounting assemblies, each of which comprises an upper ring-shaped sight engagement portion and a pair of downwardly projecting spaced apart mounting arms having inwardly projecting mounting portions thereon;

each of the firearms having a receiver portion provided with an upwardly facing sight mounting surface provided with two pair of longitudinally spaced apart internally tapped upwardly facing bores, the tapped bores of each pair thereof on each of the firearm receivers being spaced a different longitudinal distance apart from the pairs of bores on the other of the firearm receivers, the improvement comprising, a universal telescopic sight mounting system, comprising a pair of longitudinally spaced apart mounting plates associated one with each of the sight mounting assemblies of the telescopic sight;

each of said mounting plates being provided with a plurality of pairs of longitudinally spaced vertically disposed through-bores, the longitudinal spacing between each pair of through-bores being equal to the longitudinal spacing between the pairs of tapped bores of one of the firearm receivers;

a first fastening means comprising two pairs of threaded fasteners, one of said pairs being associated with one of said adapter plates and the other said pairs being associated with the other of said adapter plates, whereby said adapter plates are adapted to be surmounted on said mounting surface of any of the firearms with one of the pairs of bores in each of the adapter plates being aligned with the corresponding spaced pair of tapped bores in the associated firearm receiver, and be secured to the receiver by one of the pairs of threaded fasteners, each of said adapter plates being formed with a pair of longitudinally extending grooves along the longitudinal sides thereof, said grooves removably receiving the inwardly projecting mounting portions of one of said sight mounting assemblies, and second fastening means extending laterally through said mounting portions and said adapter plate for fixedly securing said assembles and hence the telescopic sight to the associated of said mounting plates.

3. The invention as set forth in claim 2, wherein at least one of the firearms has a cylindrical upper sight mounting surface on its receiver portion and at least one of the firearms has a relatively flat upper sight mounting surface on its receiver portion, and wherein each of the adapter plates is formed with a shallow concave surface on the underside thereof which is adapted to nestingly receive the sight mounting surface of each of said receivers.

4. The invention as set forth in claim 2, wherein each of said adapter plates is formed with three pairs of spaced apart bores which are arranged so as to provide at least four differently spaced apart bore sets.

5. In combination with a telescopic sight adapted to be removably mounted upon each of a plurality of rifle style firearms, the telescopic sight have a pair of mounting assemblies, each of which comprises an upper ring-shaped sight engagement portion and a pair of downwardly projecting spaced apart mounting arms having inwardly projecting mounting portions thereon;

each of the firearms having a receiver portion provided with an upwardly facing sight mounting surface provided with two pair of longitudinally spaced apart internally tapped upwardly facing bores, the tapped bores of each pair thereof on each of the firearm receivers being spaced a different longitudinal distance apart from the pairs of bores on the other of the firearm receivers, the improvement comprising, a universal telescopic sight mounting system, comprising a pair of longitudinally spaced apart mounting plates associated one with each of the sight mounting assemblies of the telescopic sight;

each of said mounting plates being provided with three pairs of longitudinally spaced vertically disposed through-bores, the longitudinal spacing between each pair of through-bores being equal to the longitudinal spacing between the pairs of tapped bores of one of the firearm receivers;

a first fastening means comprising two pairs of threaded fasteners, one of said pairs being associated with one of said adapter plates and the other said pairs being associated with the other of said adapter plates, whereby said adapter plates are adapted to be surmounted on said mounting surface of any of the firearms with one of the pairs of bores in each of the adapter plates being aligned with the corresponding spaced pair of tapped bores in the associated firearm receiver, and be secured to the receiver by one of the pairs of threaded fasteners, each of said adapter plates being formed with a pair of longitudinally extending grooves along the longitudinal sides thereof, said grooves removably receiving the inwardly projecting mounting portions of one of said sight mounting assemblies, and second fastening means extending laterally through said mounting portions and said adapter plate for fixedly securing said assembles and hence the telescopic sight to the associated of said mounting plates, wherein at least one of the firearms has a cylindrical upper sight mounting surface on its receiver portion and at least one of the firearms has a relatively flat upper sight mounting surface on its receiver portion, and wherein each of the adapter plates is formed with a shallow concave surface on the underside thereof which is adapted to nestingly receive the sight mounting surface of each of said receivers.

* * * * *